US006131638A

United States Patent [19]

Levin

[11] Patent Number: 6,131,638

[45] Date of Patent: Oct. 17, 2000

[54] AWNING RAFTER DEVICE

[75] Inventor: Sidney M. Levin, Buffalo Grove, Ill.

[73] Assignee: Service Manufacturing Corp., Aurora, Ill.

[21] Appl. No.: 08/988,147

[22] Filed: Dec. 10, 1997

[51] Int. Cl.[7] ..... E04F 10/00

[52] U.S. Cl. ..... 160/80; 160/71; 211/105.3; 410/149

[58] Field of Search ..... 160/45, 71, 80; 211/105.3, 105.5, 105.6; 410/145, 149, 146, 147, 148

[56] References Cited

U.S. PATENT DOCUMENTS

| | | | |
|---|---|---|---|
| 779,827 | 1/1905 | Willmott . | |
| 1,620,958 | 3/1927 | Girton et al. . | |
| 1,668,140 | 5/1928 | Buchheit . | |
| 2,423,402 | 7/1947 | Olsen . | |
| 2,889,840 | 6/1959 | McIlwaine . | |
| 3,025,866 | 3/1962 | Cockrum . | |
| 3,110,506 | 11/1963 | O'Brien . | |
| 3,612,145 | 10/1971 | Darula . | |
| 3,720,438 | 3/1973 | Johnson et al. . | |
| 3,836,174 | 9/1974 | Holman, Jr. | 211/105.6 |
| 4,117,876 | 10/1978 | Bennett . | |
| 4,171,013 | 10/1979 | Clark . | |
| 4,508,126 | 4/1985 | Everard . | |
| 4,640,332 | 2/1987 | Turner . | |
| 4,676,536 | 6/1987 | Arbic et al. . | |
| 4,719,954 | 1/1988 | Curtis et al. . | |
| 4,744,471 | 5/1988 | Leister . | |
| 4,819,706 | 4/1989 | Quinn . | |
| 4,862,940 | 9/1989 | Atchison . | |
| 5,094,285 | 3/1992 | Murray | 160/71 |
| 5,207,255 | 5/1993 | Shannon . | |
| 5,449,032 | 9/1995 | Blevins et al. . | |
| 5,595,204 | 1/1997 | Hwang . | |
| 5,640,811 | 6/1997 | Boyle et al. . | |

*Primary Examiner*—Blair M. Johnson
*Attorney, Agent, or Firm*—Laff, Whitesel & Saret, Ltd.

[57] ABSTRACT

An optionally telescoping rafter that comprises a lockable spring-biased rafter extension piece that is slidably mounted at the end of the rafter is provided. The rafter extension piece is slidable from a retracted position to an extended position in response to movement of a pivotally mounted handle on the rafter.

18 Claims, 4 Drawing Sheets

AWNING RAFTER DEVICE

TECHNICAL FIELD

The present invention relates generally to retractable awnings and, more particularly, to awning rafters having a spring-biased rafter extension piece to effectively lengthen the rafter and remove sag from the awning fabric.

BACKGROUND OF THE INVENTION

Recreational vehicles are commonly supplied with a retractable awning that extends from a side of the vehicle to provide a quick source of shade. The awnings typically have a rectangular fabric which is attached at one edge to the side of the vehicle and at the other edge to an awning front bar. The fabric may be rolled-up around the front bar and secured to the side of the vehicle when not in use.

The awning front bar, in a basic design, provides a part of a support frame for the leading edge of the fabric and means for attaching a pair of support legs to elevate the awning front bar. A pair of telescoping rafters extends between the ends of the front bar and the vehicle to frame the fabric and space the awning front bar away from the side of the vehicle when the awning is erected. The front bar optionally may be spring-loaded to automatically roll-up the awning fabric when the awning is retracted.

The awning front bar is usually provided with a groove extending lengthwise along the body thereof to receive and retain a bead of fabric formed along the leading edge of the awning fabric to affix the fabric to the front bar. The front bar is commonly adapted at its ends to pivotally mount a pair of telescoping main support legs. The main support legs may be staked into the ground or may be pivotally mounted low along the side of the vehicle.

The awning is erected by pulling the front bar away from the side of the vehicle, which causes the awning fabric to unroll from the front bar. Then the support legs are locked and secured in their fully extended position, and the rafters are extended and attached to the side of the vehicle. The telescoping rafters and supporting legs are commonly provided with locking mechanisms such as spring loaded button locks or threaded locking screws to maintain the support legs and rafters in their extended positions. A variety of awnings for recreational vehicles are disclosed by U.S. Pat. Nos.: 2,432,402; 2,889,840; 3,720,438; 4,117,876; 4,171,013; 4,640,332; 4,719,954; and 4,862,940. The U.S. patents cited thoughout this document are hereby incorporated herein by reference.

U.S. Pat. No. 4,508,126 discloses a telescoping rafter for use with an awning for recreational vehicles. The rafter has three bar-like sections. The outer bar and middle bar are slideably connected by a pin through a slot on the outermost bar. The inner bar and middle bar are connected by a pivot pin that allows these two bars to pivot relative to one another. The rafter further includes a spring housed between the outer bar and middle bar so that when the rafter is pivoted into a fully extended position, the spring is compressed between the outer bar and middle bar telescoping the outer bar to maintain force on the awning fabric.

The Darula U.S. Pat. No. 3,612,145 discloses a telescoping bar used as a support for an awning and having a handle mechanism for telescoping and retracting the bars. As the handle is closed, the rafter lengthens. Once the awning fabric is fully taut, a spring within the rafter is compressed to limit further telescoping of the rafter. The compressed spring also provides a tension locking action.

A common problem with retractable awnings used on recreational vehicles and the like involves providing an awning structure that is easy to erect, yet has rafters capable of maintaining sufficient tension on the awning fabric. To telescope the rafters enough to keep the awning fabric taut requires strength and coordination. It is difficult for one person to exert enough pressure on the rafter to stretch the awning fabric taut and simultaneously extend and lock the rafters into position because of the counteracting force exerted by the fabric. It would be very desirable to provide improved rafters that are easily installed and extended to a locked position and provide sufficient tension to remove undesirable sag from the awning fabric.

SUMMARY OF THE INVENTION

The present invention provides an optionally telescoping rafter that comprises a lockable spring-biased rafter extension piece that is slidably mounted at the end of the rafter and is moveable from a retracted position to an extended position in response to movement of a pivotally mounted handle. With the handle in the retracted position, and the rafter otherwise fully extended, the awning has some sag. This allows the rafters to be easily telescoped, locked into position and connected to the side of the vehicles without significant resistance from stretching the awing fabric. Then, the rafter extension piece is moved into its fully extended position by closing the pivotally mounted handle which drives a linkage system to increase the effective overall length of the rafter by about ¾" to 2" or more and removes sag from the awning fabric.

In a presently preferred embodiment, the rafter and rafter extension piece are generally square or round in cross section, with the rafter extension piece mounted inside the rafter. The pivotally mounted handle is U-shaped to fit over the rafter body when the handle is closed. In a particularly preferred embodiment, the linkage system connecting the handle to the rafter extension piece comprises a pair of drive links connected at one end to opposing sides of the handle. The drive links are slideably (and pivotally) mounted at the other end by a slide pin extending through slots in opposing side walls of the rafter and through similar slots in the rafter extension piece. The linkage system further comprises a coil spring "caged" inside the rafter extension piece between the slide pin and a closure means at the outer end of the rafter extension piece (e.g. a cage pin). When the slide pin is moved along the slots toward the outer end of its length of travel, the coil spring and the rafter extension piece slide forward as a unit. The resisting force against the rafter extension piece caused by stretching the awning fabric taut, works to compress the coil spring against the slide pin. In a particular preferred embodiment the rafter is pivotally mounted to the awning front bar by the cage pin which functions also as a pivot pin.

The rafters of the present invention are particularly advantageous for use with awnings for "pop-up" campers. In a preferred embodiment of the present invention, the awning may be compactly stored with the support legs and the rafters retracted and pivoted to extend laterally along channels provided in the awning front bar, and with the awning fabric rolled up on the front bar. The awning is erected by (i) unrolling the awning fabric, (ii) pivoting, telescoping and locking the support legs and rafters into their respective extended positions, (iii) securing the support legs to the ground and (iv) securing the rafters to the side of the vehicle. The length of the rafters is then incrementally increased by pivoting the rafter handle of each rafter from its open position to its closed (extended) position causing the linkage system to slide the rafter extension piece relative to the rafter to remove sag from the awing fabric.

DETAILED DESCRIPTION OF THE INVENTION

Figure 1:
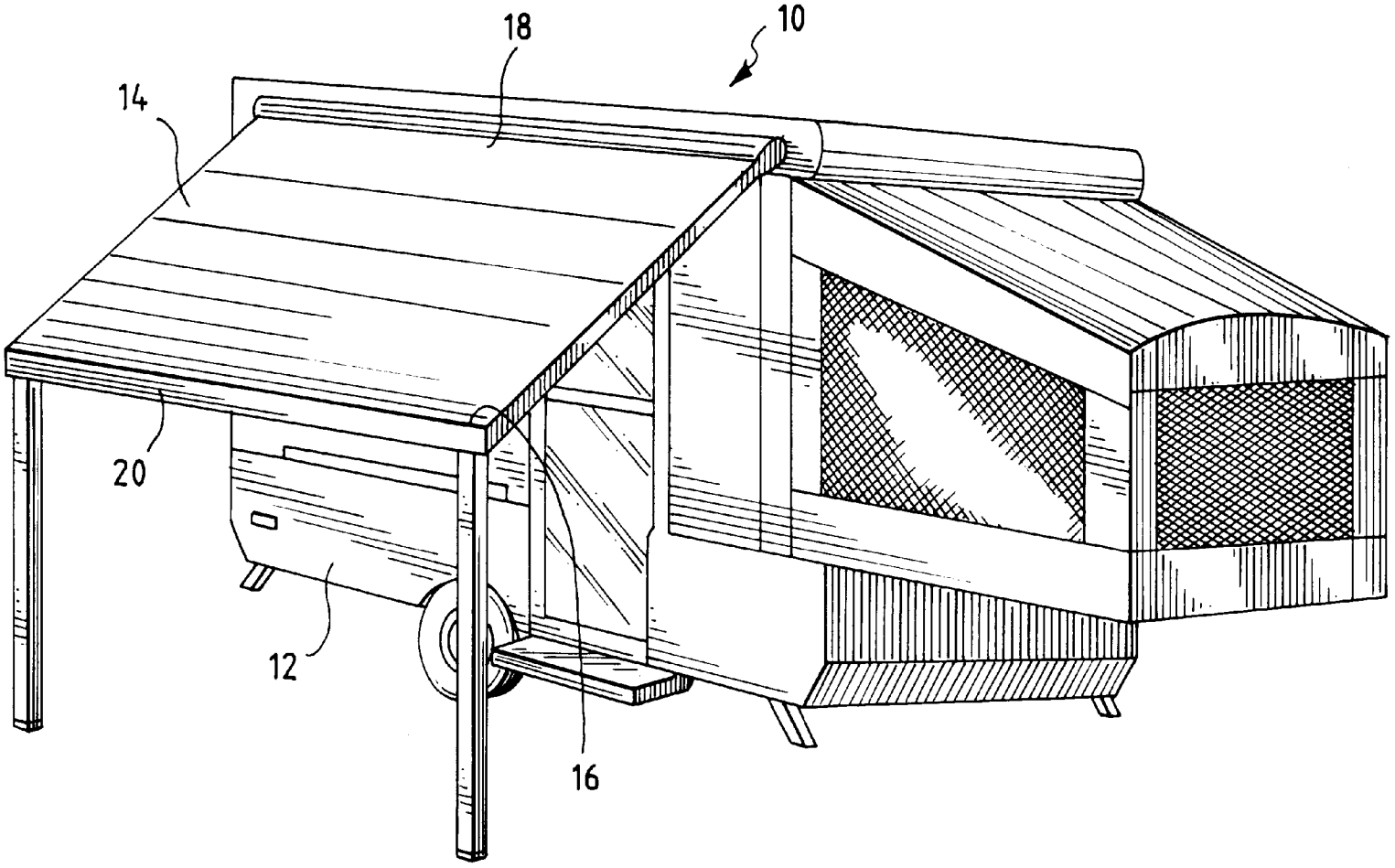
FIG. 1 is a perspective view of a pop-up camper with an awning attached to the side thereof.

Referring to FIG. 1, recreational vehicle 10 is shown with an awning mounted on the side 12 thereof. The awning includes a generally rectangular piece of fabric 14 having a leading edge 16 and a trailing edge 18. The awning is conventionally attached along its trailing edge 18 to side 12 of the recreational vehicle by a rail (not shown) extending horizontally along an upper portion of the vehicle's side. The structural components of the awning include an awning front bar 20 to which the leading edge 16 of the fabric 14 is attached and upon which fabric 14 may be rolled for storage. While the present invention is described with respect to a recreational vehicle or the like, it will be understood that retractable awnings may be attached to any suitable, fixed vertical surface such as a building or the like.

Figure 2:
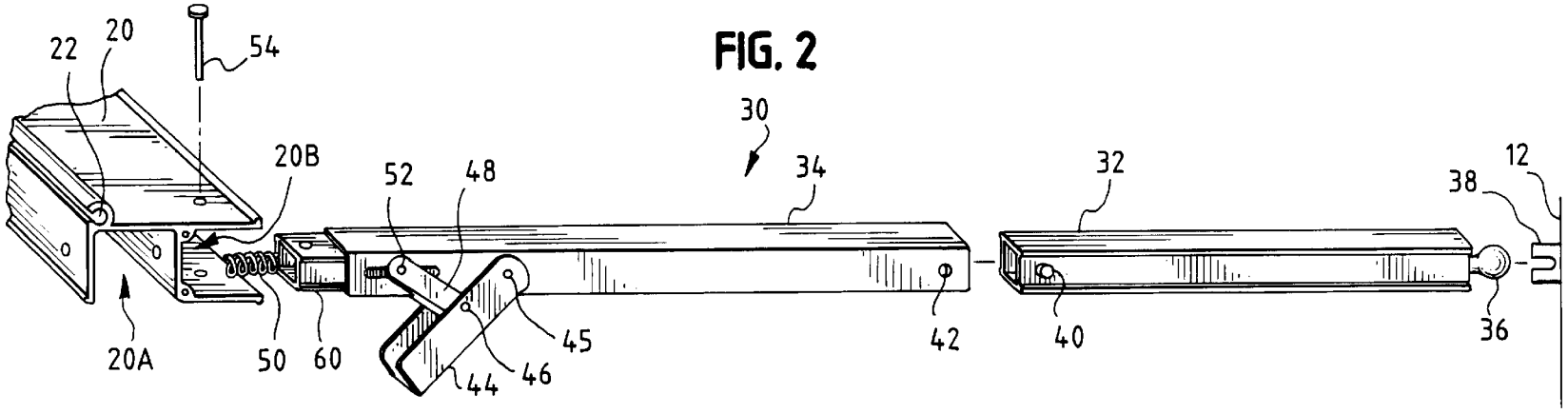
FIG. 2 is a partially exploded view of an improved rafter of the present invention and the awning front bar to which it may be pivotally connected.

With reference to FIG. 2, the awning front bar 20 is an extruded dual-channel bar including a downwardly facing first channel (generally designated 20A) to receive the pivotable support legs in the storage position and a rearwardly facing second channel (generally designated 20B) to receive the pivotable rafters in the storage position. The top face of the awning front bar is provided with a longitudinal groove 22 to receive and retain the leading edge 16 of the awning fabric.

The improved rafter of the present invention may comprise an inner rafter 32 and an outer rafter 34 which slide in telescoping fashion relative to one another. Inner rafter 32 has an inner end and an outer end. The inner end of inner rafter 32 is adapted to carry ball component 36 of a ball joint for attachment to a complementary socket 38 which is mounted on the side 12 of the vehicle. The inner rafter 32 is sized to slidingly fit inside of outer rafter 34. The outer end of inner rafter 32 is provided with a spring button locking mechanism 40 as known in the art. The inner end of outer rafter 34 is provided with complementary opposed openings 42 to reversibly engage the button lock 40 when inner rafter 32 and outer rafter 34 are fully telescoped.

The ball joint arrangement mentioned above provides a quick-release or "break away" feature that prevents the socket 38 from being pulled out of side 12, potentially damaging the vehicle, where, for example, a wind gust upsets the awning. To facilitate the "break away" feature of the ball joint, socket 38 is made from a resilient plastic material. Also, socket 38 may also be provided with cut-outs (depicted in FIG. 2) to facilitate the "break away" feature.

A U-shaped handle 44 is pivotally mounted to outer rafter 34 by rivets 45 and is movable between an open position and a closed position. In the closed position, the handle lies flat against outer rafter 34, as the U-shaped handle forms a channel to fit around the rafter.

In a preferred embodiment, handle 44 is linked to rafter extension piece 60 by a linkage system comprising a pair of drive links 48, a coil spring 50, a slide pin 52 and a cage pin 54. While two drive links 48 are preferably used, it will be appreciated that the linkage system may include a single drive link.

Each drive link 48 is pivotally attached at one end to opposing inside surfaces of handle 44 by rivets 46. Drive links 48 are slidingly (and pivotally) attached at their other end to outer rafter 34 by slide pin 52 which extends through a pair of slots provided in opposing sides of outer rafter 34 and a pair of slots provided in opposing sides of rafter extension piece 60. See also FIG. 3. A coil spring 50 is caged between slide pin 52 and cage pin 54 extending through rafter extension piece 60 near its outer end. In a presently preferred embodiment, the drive links 48 measure approximately 3.5"×1.6"×0.12", the outer rafter is about 1"×1"×42", the rafter extension piece is about 0.75"×0.75"×4.75" and the spring is about 2.25" in length and 0.6" (o.d.).

Coil spring 50 preferably is sized so that its length is slightly longer than the distance between the slide pin 52 and pin 54 when the rafter is assembled. Thus, the spring 50 is slightly compressed when installed.

Figure 3:
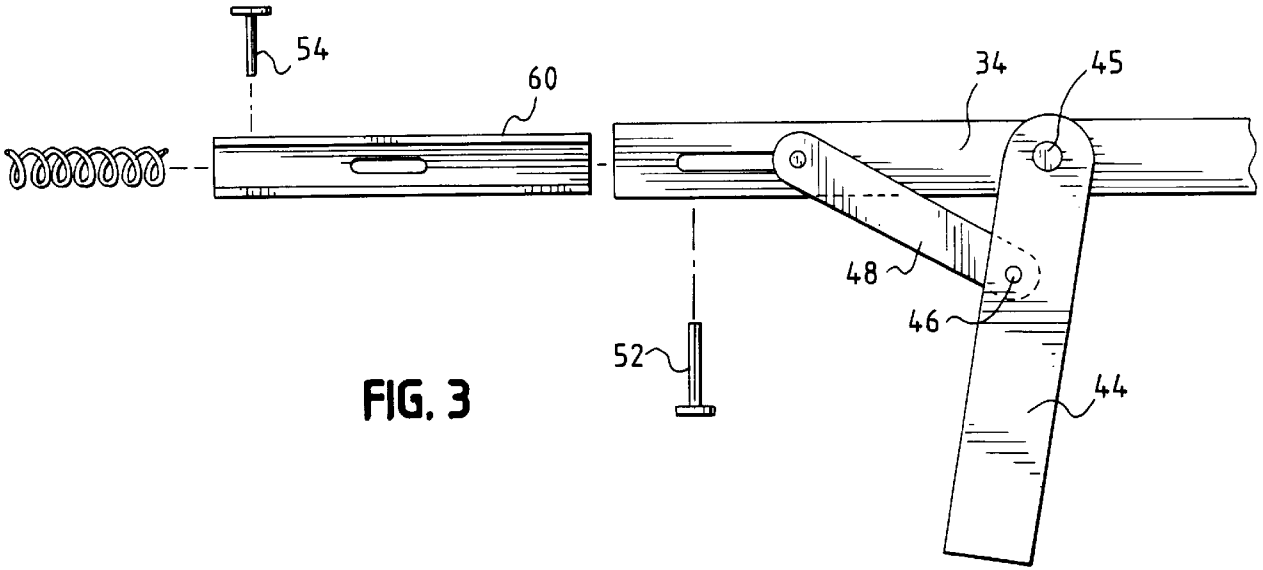
FIG. 3 is a partially exploded view of the rafter shown in FIG. 2 showing the rafter extension piece and drive links prior to being linked to the outer rafter during assembly.

As best seen in FIG. 3, in a particularly preferred embodiment, the slots in outer rafter 34 are proportionately longer than the slots in extension piece 60 (1.7" and 1", respectively). Drive links 48, when advanced by pivoting handle 44, slide coil spring 50 and extension piece 60 (which together with pins 52, 54 form a spring cartridge unit) to a fully extended position without further compression of spring 50, except for the compression caused by the counteracting force of the stretched awing fabric. In a preferred embodiment, coil spring 50 provides 40–60 pounds of pressure at ¾" compression to stretch the fabric taut.

The tension on the spring when the rafters are not under compression (e.g., in the storage position) provides a tension lock for the handle. As will be appreciated, the tension lock is a function of the orientation between rivets 45, rivets 46 and slide pin 52. When the handle is closed, the drive links become "overcentered" such that rivets 46 are located past (i.e., overcentered with respect to) a line defined between rivets 45 and slide pin 52. In this orientation, the force of the coil spring on the drive links will have a small component force urging handle 44 to remain in the closed position.

Figure 4:
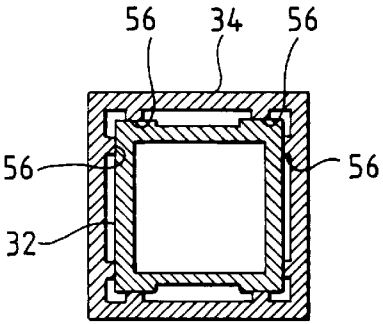
FIG. 4 shows a cross-section through an outer rafter having longitudinally extending ribs inside the outer rafter to provide sidewall clearance for attaching the handle to the outer rafter without interfering with the path of the telescoping inner rafter.
Figure 6:
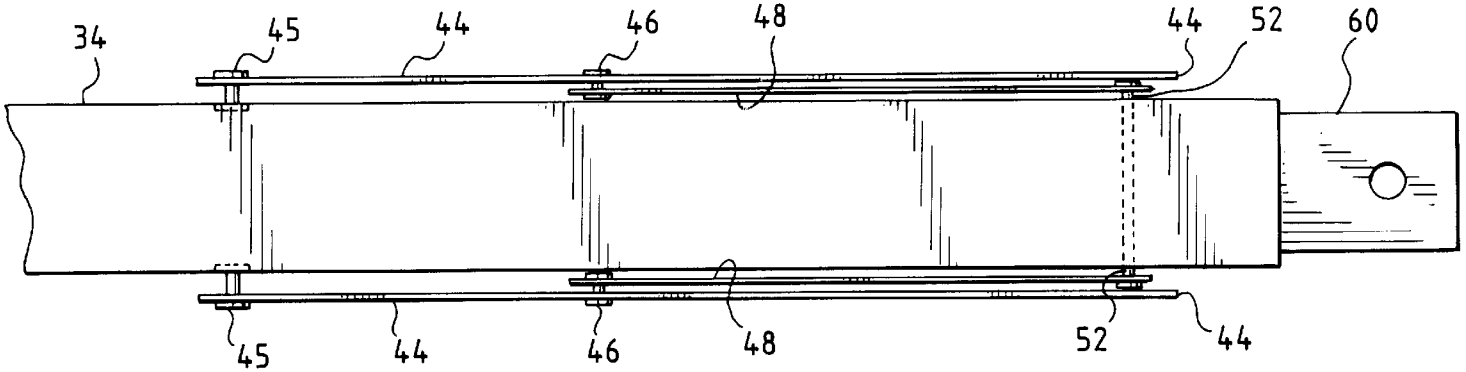
FIG. 6 is a top view of the rafter showing the relative orientation of the pivoting handle (closed position), the drive links and the slide pin.

As best seen in FIG. 4 (cross-sectional view through outer rafter 34 and extension piece 60), outer rafter body 34 is provided, such as by a machining operation, with longitudinally extending ribs 56 along its inside surface. Each inside wall of outer rafter 34 has two longitudinally extending ribs 56 disposed relatively near its inside corners. These ribs 56 act as guide rails upon which the rafter extension piece 60 and the inner rafter 32 may slide. Because rails 56 are positioned near the inside corners of outer rafter body 34, they effectively provide clearance for inner rafter 32 to slide past rivets 46 (not shown) used to mount handle 44 to rafter 34 when inner rafter 32 is retracted. Further clearance for rivets 46 is provided by the recessed sides 58 of the inner rafter body 32. As rafter extension piece 60 also is sized to slide within outer rafter 34, a common extrusion (e.g., aluminum) can be used to provide inner rafter 32 and rafter extension piece 60.

As noted above, the rafters of the present invention may be pivotally connected to respective ends of the awning front bar 20 by pivot pins. In a presently preferred embodiment, cage pins 54 pivotally connect each rafter to respective ends of front bar 20. Thus, cage pin 54 serves the dual purposes of pivotally attaching the rafter extension piece to the awning front rail and caging coil spring 50. When the rafters are so installed on the awning front bar 20, the rafters can articulate about cage pin 54 from a stored position (parallel to the awning front bar) to a set-up position (perpendicular to the awning bar).

Figure 5:
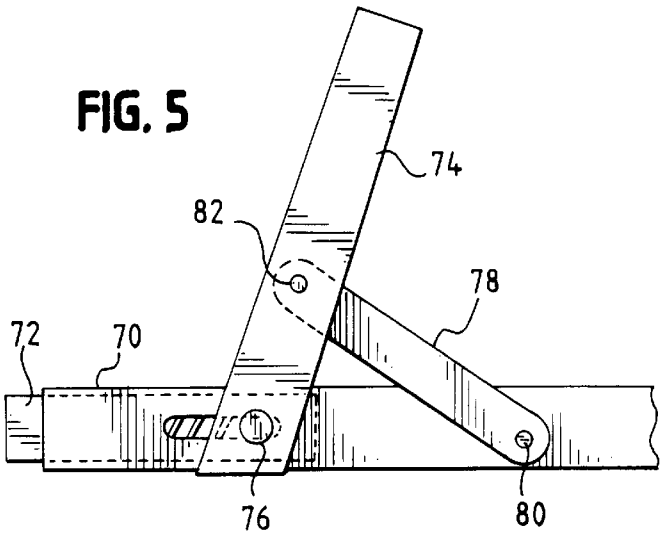
FIG. 5 is a side view of a section of an outer rafter showing an alternative embodiment of the present invention having the handle mounted on the slide pin.

As shown in FIG. 5, in an alternative embodiment, the improved rafter of the present invention may be an outer rafter 70 and rafter extension piece 72 slidingly associated therewith and configured similarly to the embodiment depicted in FIGS. 2 and 3, except that handle 74 is pivotally mounted on slide pin 76 and drive links 78 are pivotally mounted to outer rafter 70 by rivets 80. Drive links 78 are further pivotally mounted to handle 74 by rivets 82.

As will be appreciated, the outer rafter 34 should be approximately one half the length of awning front bar 20 so that both outer rafters 34 (attached at respective ends of awning front bar 20) can be pivoted to the storage position in channel 20B without overlap. In a particularly preferred embodiment, the length of outer rafter 34 is slightly shorter than the combined lengths of inner rafter 32 and extension piece 60, and when the latter are in their storage positions the inner rafter and extension piece abut one another inside the outer rafter. By having inner rafter 32 abut rafter extension piece 60 in the storage position, pivoting the handle 44 from its closed position to its open position retracts the rafter extension piece 60 into outer rafter 34 which in turn ejects inner rafter 32 from outer rafter 34 to expose e.g., ball 36, so that inner rafter 32 may be easily grasped and telescoped into the set-up position. In a preferred embodiment, the awning front bar 20 is approximately 7 feet long and each outer rafter 34 is approximately 3½ feet long.

Figure 7:
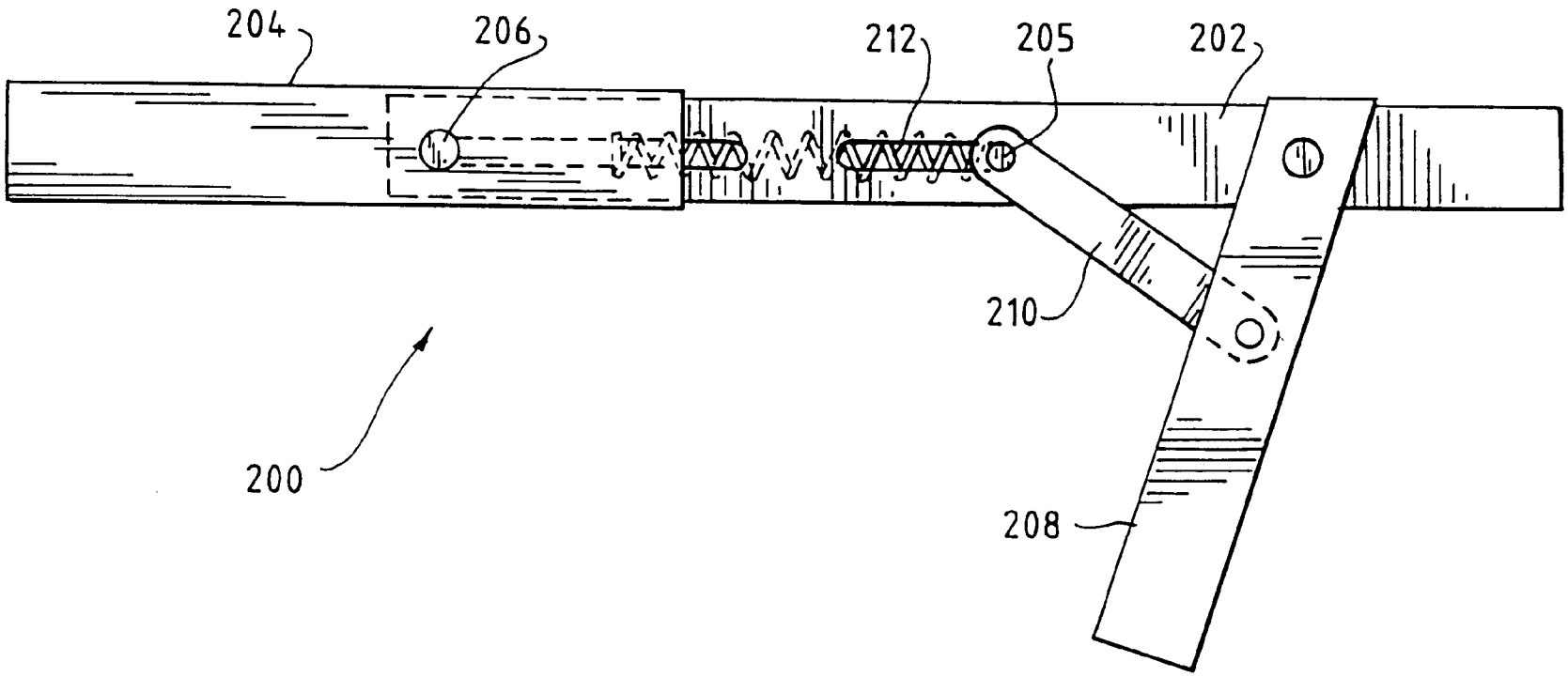
FIG. 7 is a side view of an embodiment of the improved rafter of the present invention in which the rafter extension piece is mounted on the outside of the rafter.

FIG. 7 shows another embodiment of a rafter of the present invention. Rafter 200 includes an outer rafter 202 with rafter extension piece 204 mounted on the outside thereof. In this embodiment, two slide pins 205, 206 are used. Outer rafter 202 is provided with two pairs of slots (in series) extending longitudinally along the rafter. Each pair of slots is sized and shaped to accept a respective one of the slide pins 205, 206. In this embodiment, handle 208 and drive links 210 are mounted to outer rafter 202 as described above, except that slide pin 205 connects the drive links 210, but not rafter extension piece 204, to outer rafter 202. Rafter extension piece 204 (mounted over outer rafter 202) is connected by slide pin 206 to outer rafter 202. Coil spring 212 is disposed between the two slide pins 205, 206. Coil spring 212 preferably is sized so that it is slightly compressed when handle 208 is in the closed position (to provide a tension lock), but free-sliding when the handle is open. Rafter 200 is pivotally mounted to awning front bar 20 by a pivot pin (not shown) passing through the outer potion of rafter extension piece 204.

While a single pair of slots could be used to slidingly mount drive links 210 and the extension piece 202 with slide pins 205 and 206, respectively, it is preferred in this alternative embodiment (i.e., rafter extension piece mounted over the outer rafter) to use two pairs of slots which are spaced apart to maintain rigidity of outer rafter 202. The two pairs of slots may be generally aligned with each other such that the slide pins 205, 206 are arranged as shown in FIG. 7, although it will be understood that slide pin 206 could be oriented to pass through slots in the adjacent sidewalls of outer rafter 202 (i.e., slide pins perpendicular to each other).

Applicants' foregoing description of the present invention is illustrative. Other modifications and variations will be apparent to those of ordinary skill in the art in light of applicants' specification, and such modifications and variations are within the scope of their invention defined by the following claims.

We claim:

1. A rafter for use in a retractable awning, the rafter comprising:

a) an elongated rafter body;

b) a rafter extension piece slidably associated with the rafter body and extending from an end thereof;

c) a handle pivotally associated with the rafter body and pivotable from a first open position to a second closed position; and d) means including a drive member pivotally attached to the handle and slidably attached to the rafter body, for linking the handle to the rafter extension piece such that pivoting the handle from the first position to the second position slides the extension piece to incrementally increase the effective length of the rafter.

2. A rafter for use in a retractable awning, the rafter comprising:

a) an elongated rafter body;

b) a rafter extension piece slidably associated with the rafter body and extending from an end thereof;

c) a handle pivotally associated with the rafter body and pivotable from a first open position to a second closed position; and d) a linkage system including a drive link having first and second ends, the first end pivotally connected to the handle and the second end slidably connected to the rafter body, the second end being coupled to the extension piece such that pivoting the handle from the first open position to the second closed position slides the extension piece to incrementally increase the effective length of the rafter.

3. A rafter according to claim 2, wherein the linkage system further comprises a coil spring slidingly disposed within the rafter body between the second end of the drive link and the extension piece for compression by the rafter extension piece.

4. A rafter according to claim 3 wherein the rafter extension piece is slidably mounted inside the rafter body.

5. A rafter according to claim 4 wherein the rafter body has a first pair of slots in opposing sidewalls, and the rafter extension piece has a second pair of slots in opposing sidewalls, and the drive link is connected to the rafter extension piece by a slide pin extending through the first and second pair of slots.

6. A rafter according to claim 2 wherein (i) the rafter body has a first pair of slots in opposing sidewalls, and the rafter extension piece has a second pair of slots in opposing sidewalls; and (ii) the linkage system comprises (a) a pair of drive links pivotally connected at one end to the handle and slidably connected at the other end to the rafter body; and (b) a slide pin which extends through the first and the second pair of slots to connect the drive links to the rafter extension piece.

7. A rafter according to claim 6 wherein the rafter extension piece is slidably mounted inside the rafter body.

8. A rafter according to claim 7 wherein the linkage system further comprises a coil spring caged inside the rafter extension piece and slidably associated with the drive links.

9. A rafter according to claim 8 further comprising a cage pin extending through opposing sidewalls of the rafter extension piece.

10. A rafter according to claim 9 wherein the coil spring is caged between the slide pin and the cage pin.

11. A rafter according to claim 10 wherein the handle is U-shaped and the drive links are pivotally mounted to the inside walls of the handle.

12. A rafter according to claim 11 wherein the U-shaped handle is pivotally mounted to the rafter body by a pair of rivets extending through opposing sidewalls of the rafter body.

13. A rafter according to claim 12 wherein the rafter body comprises an outer rafter portion and an inner rafter portion, the outer rafter portion being substantially hollow and the inner rafter portion being sized and shaped to telescopingly slide within the outer rafter body.

14. A rafter according to claim 13 wherein the outer rafter portion further comprises rails extending longitudinally along the inside walls thereof.

15. A rafter according to claim 14 wherein the rails are positioned adjacent to the inside corners of the outer rafter portion.

16. A rafter according to claim 15 wherein (i) the inner rafter portion is substantially completely disposed within the outer rafter portion when the inner rafter portion is fully retracted and the rafter extension piece is fully extended and (ii) an end of the inner rafter portion is urged outward from the outer rafter portion when the rafter extension piece is retracted from the fully extended position.

17. A rafter according to claim 16 wherein the drive links are connected to the handle in an orientation that provides a tension lock when the handle is in its closed position.

18. A rafter according to claim 13 wherein the incremental increase in the effective length of the rafter is between about ¾" and 2".

* * * * *